US011007401B2

(12) United States Patent
Kennedy et al.

(10) Patent No.: US 11,007,401 B2
(45) Date of Patent: May 18, 2021

(54) APPARATUS, SYSTEM, AND METHOD FOR EXERCISE EQUIPMENT WITH CARRY ARMS

(71) Applicant: Core Health & Fitness, LLC, Vancouver, WA (US)

(72) Inventors: Charles Kennedy, Moon, PA (US); Shawn Reed, Moon, PA (US); Kevin Corbalis, Tustin, CA (US); Steve Neill, Anaheim, CA (US); Ken Duong, Lake Forest, CA (US)

(73) Assignee: Core Health & Fitness, LLC, Vancouver, WA (US)

( * ) Notice: Subject to any disclaimer, the term of this patent is extended or adjusted under 35 U.S.C. 154(b) by 73 days.

(21) Appl. No.: 15/470,895

(22) Filed: Mar. 27, 2017

(65) Prior Publication Data

US 2018/0272178 A1 Sep. 27, 2018

(51) Int. Cl.

| | |
|---|---|
| ***A63B 21/00*** | (2006.01) |
| ***A63B 22/02*** | (2006.01) |
| ***A63B 22/00*** | (2006.01) |
| ***A63B 21/06*** | (2006.01) |
| ***A63B 23/035*** | (2006.01) |
| ***A63B 23/04*** | (2006.01) |
| *A63B 22/06* | (2006.01) |

(52) U.S. Cl.

CPC ..... *A63B 21/4035* (2015.10); *A63B 21/0615* (2013.01); *A63B 22/0005* (2015.10); *A63B 22/0012* (2013.01); *A63B 22/02* (2013.01); *A63B 23/03541* (2013.01); *A63B 22/0664* (2013.01); *A63B 23/047* (2013.01)

(58) Field of Classification Search

CPC ..... A63B 22/02–0292; A63B 21/06; A63B 21/062–0632

See application file for complete search history.

(56) References Cited

U.S. PATENT DOCUMENTS

| | | | | |
|---|---|---|---|---|
| 5,000,440 | A * | 3/1991 | Lynch | A63B 21/0615 482/112 |
| 5,667,464 | A * | 9/1997 | Simonson | A63B 23/1254 482/134 |
| 5,833,577 | A * | 11/1998 | Hurt | A63B 22/02 482/54 |
| 5,957,817 | A * | 9/1999 | Koenig | A63B 21/0615 482/137 |
| 7,476,183 | B1 * | 1/2009 | Chrest | A63B 21/072 482/908 |
| 7,641,602 | B2 * | 1/2010 | Rogers | A63B 21/0615 482/100 |
| 9,409,050 | B2 * | 8/2016 | Mintz | A63B 22/02 |
| 9,511,258 | B2 * | 12/2016 | Hoole | A63B 23/1236 |
| 9,914,003 | B2 * | 3/2018 | Kuehne | A63B 69/0064 |

(Continued)

*Primary Examiner* — Nyca T Nguyen

(74) *Attorney, Agent, or Firm* — Kunzler Bean & Adamson

(57) ABSTRACT

An exercise machine. The exercise machine includes a frame, a foot engagement surface operably connected to the frame, and an arm rotatably connected to the frame at a pivot. The arm includes a handle connected to the arm at a first location distal to the pivot. The handle is configured to be gripped by a user. The arm includes a weight receiver connected to the arm at a second location distal to the pivot. The weight receiver is configured to hold one or more weights to modify a downward force provided at the handle.

17 Claims, 7 Drawing Sheets

(56) References Cited

U.S. PATENT DOCUMENTS

| | | | | |
|---|---|---|---|---|
| 2007/0155595 | A1* | 7/2007 | Rogers | A63B 21/0615 482/94 |
| 2009/0253559 | A1* | 10/2009 | Maresh | A63B 21/00072 482/93 |
| 2011/0281691 | A1* | 11/2011 | Ellis | A63B 22/0012 482/54 |
| 2016/0001119 | A1* | 1/2016 | Jue | A63B 69/0064 482/54 |

* cited by examiner

APPARATUS, SYSTEM, AND METHOD FOR EXERCISE EQUIPMENT WITH CARRY ARMS

CROSS-REFERENCE TO RELATED APPLICATIONS

N/A

SUMMARY

Embodiments of an exercise machine are described. The exercise machine includes a frame, a foot engagement surface operably connected to the frame, and an arm rotatably connected to the frame at a pivot. The arm includes a handle connected to the arm at a first location distal to the pivot. The handle is configured to be gripped by a user. The arm includes a weight receiver connected to the arm at a second location distal to the pivot. The weight receiver is configured to hold one or more weights to modify a downward force provided at the handle. Other embodiments of the exercise machine are also described.

BRIEF DESCRIPTION OF THE SEVERAL VIEWS OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

While many embodiments are described herein, at least some of the described embodiments provide a method for providing exercise equipment with carry arms.

Figure 1:
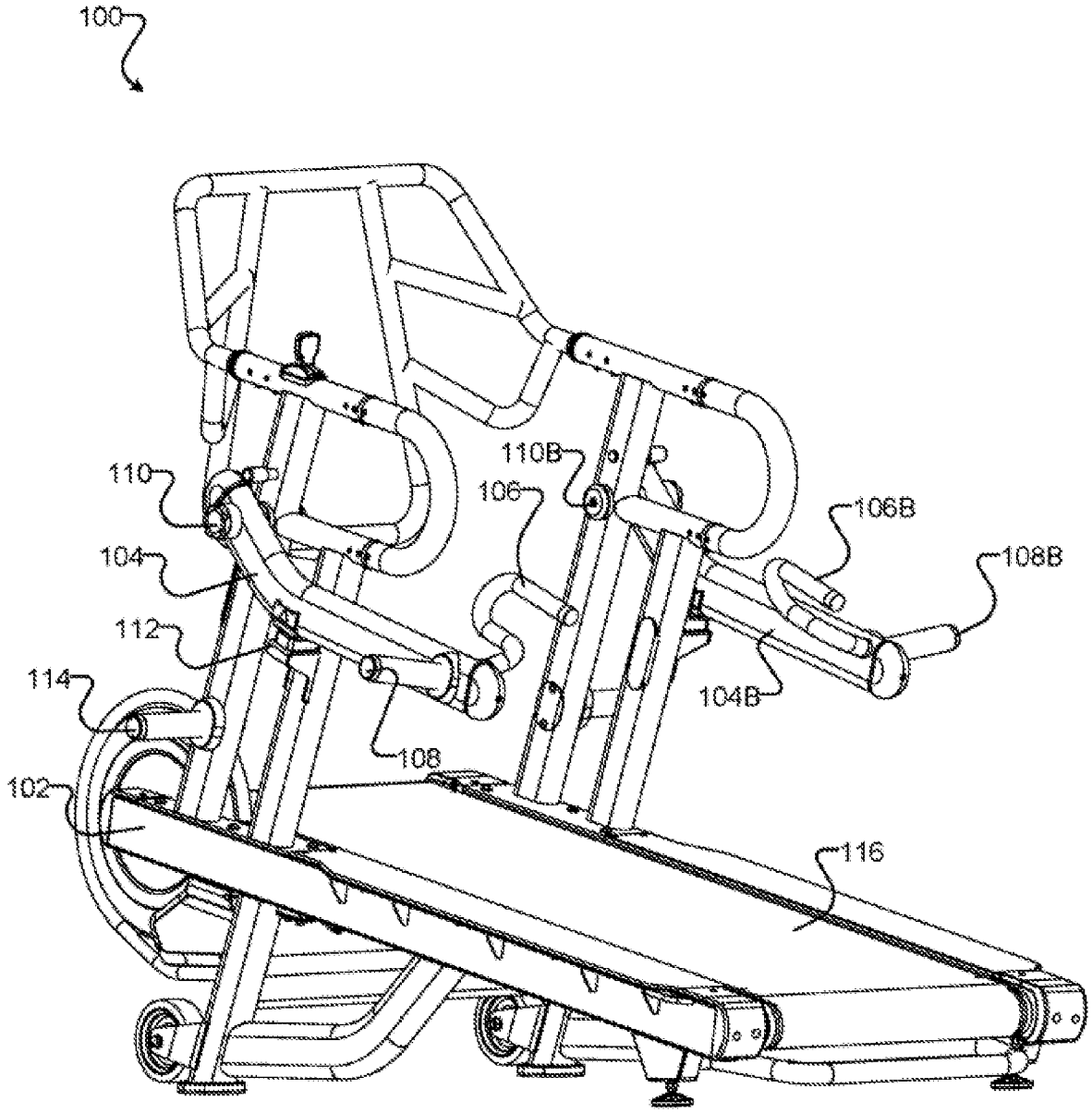
FIG. 1 depicts a perspective view of one embodiment of an exercise machine.

FIG. 1 depicts a perspective view of one embodiment of an exercise machine 100. The exercise machine 100 includes a frame 102, an arm 104, and a foot engagement surface 116. The exercise machine 100 provides exercise when operated by a user.

The frame 102, in certain embodiments, provides a structure for attaching other components of the exercise machine 100. The frame 102 may include one or more connection points for attaching other components. In some embodiments, the frame 102 includes elements that are substantially horizontal and other components that are substantially vertical. The frame 102 may include any material strong and rigid enough to support other components of the exercise machine 100. For example, the frame 102 may include steel, aluminum, stainless steel, or alloys thereof. In another example, the frame may include composite materials, such as carbon fiber or fiberglass in a polymer matrix.

The arm 104, in one embodiment, is rotatably connected to the frame 102 at a pivot 110. The pivot 110 may allow for rotation of the arm 104 relative to the frame 102. Rotation of the arm 104 may be allowed in an axis perpendicular or substantially perpendicular to a horizontal plane.

In some embodiments, the pivot 110 restricts movement of the arm 104 relative to the frame 102 to rotation around a single axis. The pivot 110 may restrict translation of the arm 104 relative to the frame 102. In some embodiments, the pivot 110 allows rotation of the arm 104 in a plurality of axes. For example, the pivot 110 may include a ball and socket joint.

The arm 104 may include a handle 106, the handle configured to be grasped by a user. The handle 106 may be connected to the arm 104 at a first location. The first location may be located at a point on the arm 104 distal to the pivot 110. In one embodiment, the pivot 110 is located at or near a first end of the arm 104 and the handle 106 is connected to the arm 104 at or near a second end of the arm 104.

In some embodiments, a weight receiver 108 is connected to the arm 104. The weight receiver 108 may be connected to the arm 104 at a second location. The second location may be located distal to the pivot 110. In some embodiments, the pivot 110 is located at or near a first end of the arm 104 and the weight receiver 108 is connected to the arm 104 at or near a second end of the arm 104.

The weight receiver 108, in one embodiment, is configured to hold one or more weights. Weights received by the weight receiver 108 modify a downward force provided at the handle 106.

The weight receiver 108 may include a post. The post may be sized to interface with one or more standard weight plates. For example, the post may be sized to interface with an Olympic sized weight plates having a bore diameter of approximately two inches.

In one embodiment, the handle 106 and the weight receiver 108 are located on the arm such that each is the same distance from the pivot 110 or substantially the same distance from the pivot 110. A hand grip on the handle 106 may be configured such that a user may grip the handle 106 and apply an upward force at the hand grip. In one embodiment, the handgrip is positioned such that a distance from the hand grip to the pivot 110 is substantially the same as a distance from the weight receiver 108 to the pivot 110. In an alternative embodiment, a length defied by the distance between the weight receiver 108 and the pivot 110 is greater a length defined by the distance between the handle 106 and the pivot.

In some embodiments, a stop 112 is connected to the frame 102. The stop 112 restricts downward rotation of the arm 104 beyond a predetermined angle. For example, the stop 112 may include a cradle that receives the arm 104 and holds the arm 104 at an angle that places a hand grip of the handle 106 at a height that is convenient for a user to grasp prior to lifting the arm 104.

The stop 112 may include a compliant material configured to absorb impact created by rapid downward rotation of the arm 104. For example, the stop 112 may include a polymer such as synthetic rubber.

In some embodiments, a storage receiver 114 is connected to the frame 102. The storage receiver 114 may be configured to receive one or more weight plates. For example, the storage receiver 114 may include a post configured to interface with Olympic size weight plates having a bore diameter of approximately two inches.

The foot engagement surface 116, in some embodiments, provides a surface for interaction with a user's foot. In one embodiment, the foot engagement surface 116 is a treadmill tread belt and the exercise machine 100 is a treadmill. The treadmill may be a treadmill including a motor to operate the treadmill tread belt or an unpowered treadmill that relies on force generated by a user to move the treadmill tread belt.

In another embodiment, the foot engagement surface 116 includes two treadmill tread belts and the exercise machine 100 is a dual-treadle treadmill. In yet another embodiment, the foot engagement surface 116 is an elliptical exercise machine pedal and the exercise machine 100 is an elliptical machine. In another embodiment, the foot engagement surface 116 is a step tread and the exercise machine 100 is a stair stepper.

In some embodiments, the exercise machine 100 includes a second arm 104B connected to the frame 102 at a second pivot 110B. The second arm 104B includes a second handle 106B and a second weight receiver 108B. The second arm 104B, the second handle 106B, the second weight receiver 108B, and the second pivot 110B are similar to components 104, 106, 108, and 110, respectively. The second arm 104B may be operated independently of the arm 104.

In one embodiment, the exercise machine 100 is operable by a user by grasping the handle 106 and lifting the arm 104 while engaging the foot engagement surface 116. One or more weight plates may be attached to the arm using the weight receiver 108, increasing the force required to lift the arm 104. Engaging the foot engagement surface 116 may include walking or running on one or more treadmill tread belts, moving in an elliptical-type motion on an elliptical machine, or other similar actions.

Figure 2A:
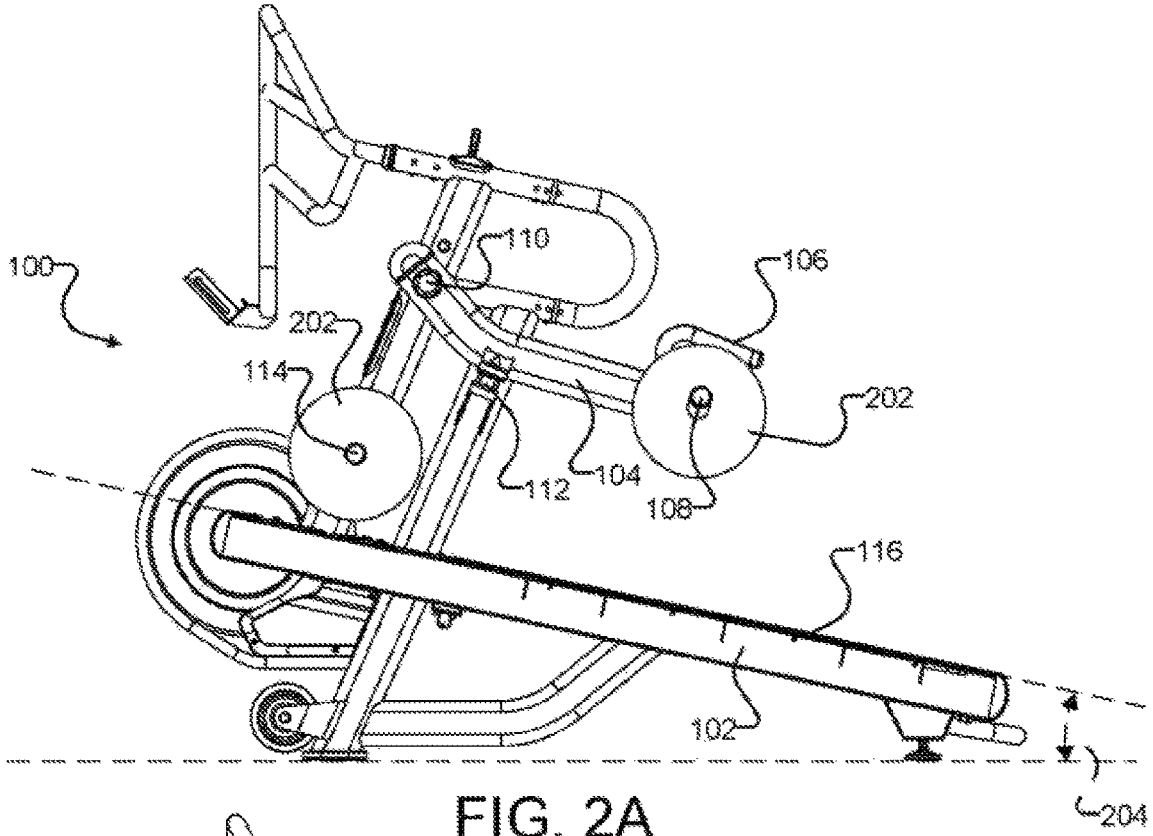
FIGS. 2A and 2B depict side views of embodiments of the exercise machine of FIG. 1.
Figure 2B:
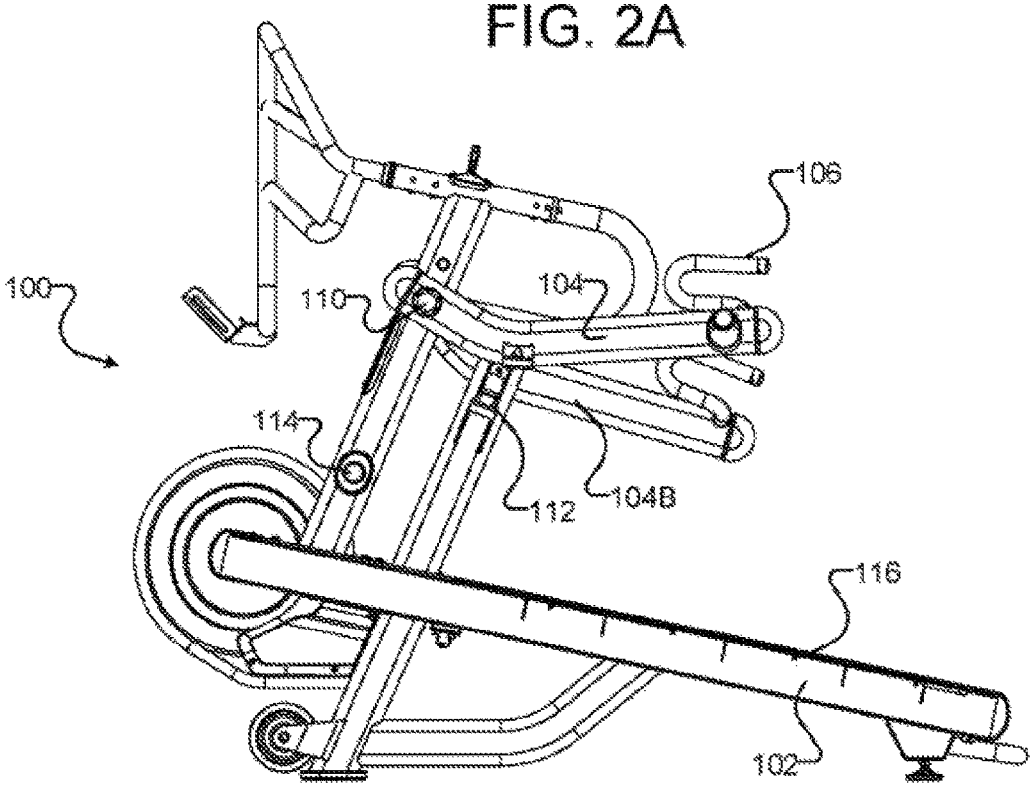

FIGS. 2A and 2B depict side views of embodiments of the exercise machine 100 of FIG. 1. The exercise machine 100 includes a frame 102, an arm 104, a handle 106, a weight receiver 108, a pivot 110, a stop 112, a storage receiver 114, and a foot engagement surface 116. The frame 102, the arm 104, the handle 106, the weight receiver 108, the pivot 110, the stop 112, the storage receiver 114, and the foot engagement surface 116 are similar to like-numbered components described above.

In some embodiments, one or more weight plates 202 are attachable to the exercise machine 100. In one embodiment, one or more weight plates 202 may be removably connected to the weight receiver 108. For example, the weight receiver 108 may include a post configured to interface with a weight plate with a center bore. In some embodiments, the post may be sized to interface with so-called Olympic plates having a center bore of approximately two inches. In another embodiment, the post may be sized to interface with so-called standard plates having a center bore of approximately one inch.

The storage receiver 114, in some embodiments, is configured to store one or more weight plates. In one embodiment, one or more weight plates 202 may be removably connected to the storage receiver 114. For example, the storage receiver 114 may include a post configured to interface with a weight plate with a center bore. In some embodiments, the post may be sized to interface with so-called Olympic plates having a center bore of approximately two inches. In another embodiment, the post may be sized to interface with so-called standard plates having a center bore of approximately one inch.

In certain embodiments, the foot engagement surface 116 includes a walking surface. The walking surface is configured for a user to walk or run on the walking surface. In some embodiments, the walking surface is substantially horizontal. In another embodiment, the walking surface is inclined such that a front end of the walking surface is higher than a back end of the walking surface. In certain embodiments, the walking surface has an incline angle 204 of approximately or exactly ten degrees. In some embodiments, the walking surface has an incline angle 204 of greater than five degrees. In another embodiment, the walking surface has an incline angle 204 that is adjustable.

The arm 104, in some embodiments, is rotatably connected to the frame 102. In one embodiment, the stop 112 restricts downward rotation of the arm 104 to a predetermined angle. FIG. 2A shows the arm 104 engaged with the stop 112 at the predetermined angle. As shown in FIG. 2B, the arm 104 may be rotated upward by lifting at the handle 106.

Figure 3:
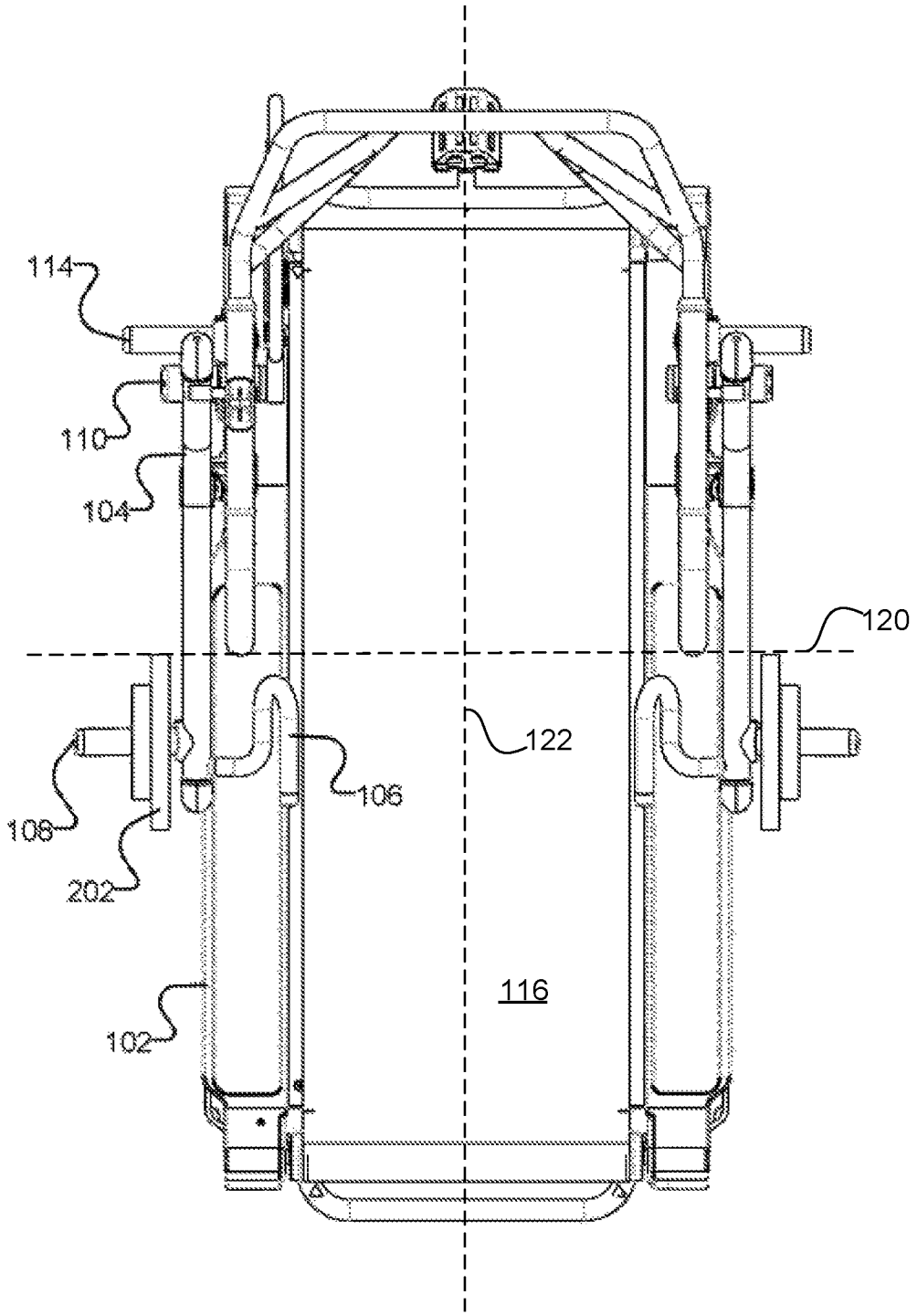
FIG. 3 depicts a top view of one embodiment of the exercise machine of FIG. 1.

FIG. 3 depicts a top view of one embodiment of the exercise machine 100 of FIG. 1. The exercise machine 100 includes a frame 102, an arm 104, a handle 106, a weight receiver 108, a pivot 110, a storage receiver 114, a foot engagement surface 116, and one or more weight plates 202. The frame 102, the arm 104, the handle 106, the weight receiver 108, the pivot 110, the storage receiver 114, the foot engagement surface 116, and the one or more weight plates 202 are similar to like-numbered components described above. Also depicted are a lateral axis 120 and a longitudinal axis 122. The longitudinal axis 122 extends from a front of the exercise machine to a back of the exercise machine 100 (i.e., where a user would step onto the back end of the foot engagement surface), and generally bisects the exercise machine lengthwise. The lateral axis 120 extends outward laterally in both directions from the longitudinal axis 122 (i.e., the "lengthwise center" of the exercise machine 100) towards and past a first side of the exercise machine 100 (e.g., a left side of the top view of FIG. 3) and towards and past a second side of the exercise machine 100 (e.g., a right side of the top view of FIG. 3). In certain embodiments, and as depicted here, the arm 104 is coupled to an exterior side surface of the frame 102 at the pivot point 110. The "exterior side" refers to an exterior surface of the right or left side of the frame 102, or in other words, the exterior of the frame refers to an area opposite the interior of the frame which is occupied by a user during operation of the exercise machine 100.

Figure 4:
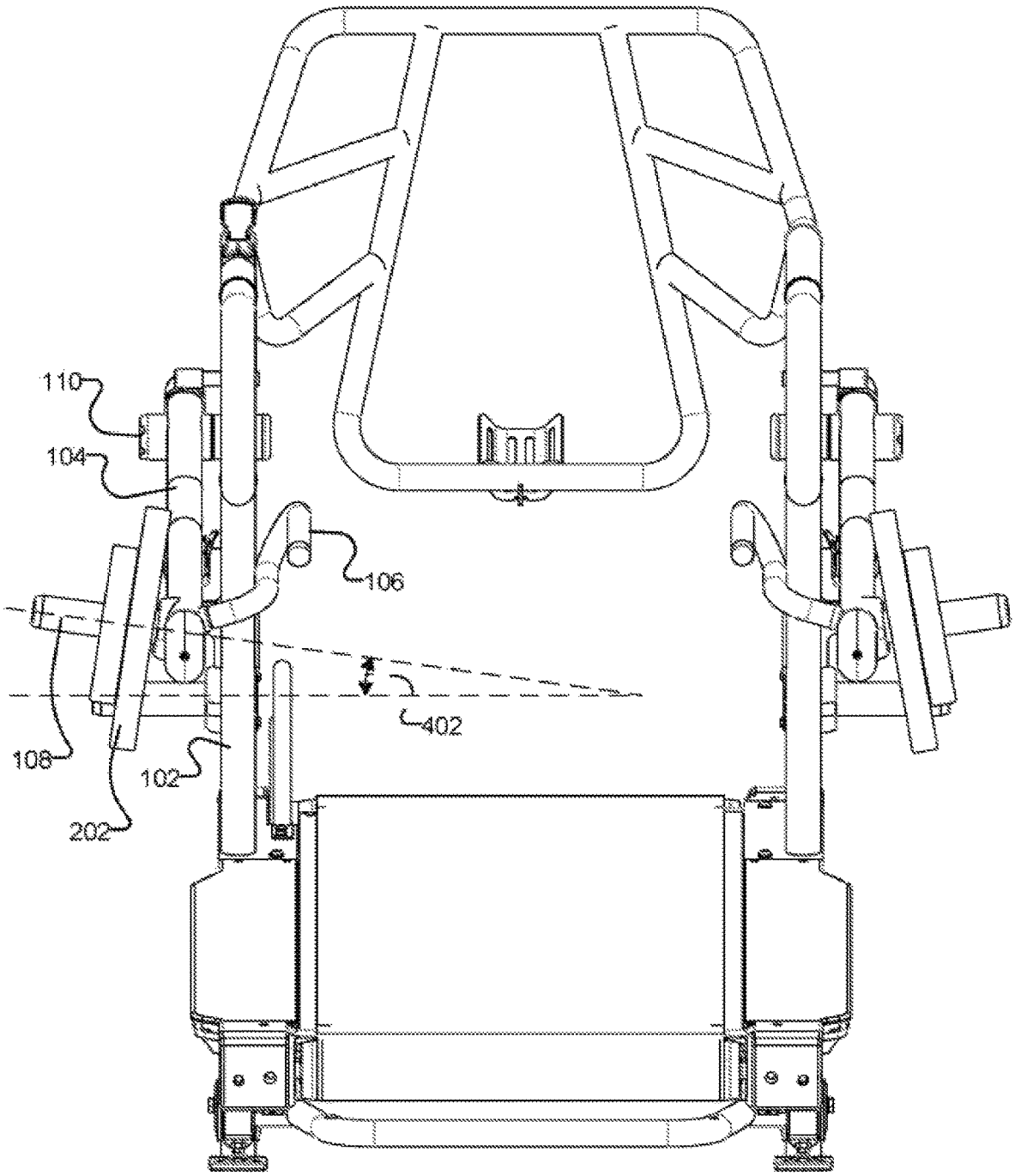
FIG. 4 depicts a back view of one embodiment of the exercise machine of FIG. 1.

FIG. 4 depicts a back view of one embodiment of the exercise machine 100 of FIG. 1. The exercise machine 100 includes a frame 102, an arm 104, a handle 106, a weight receiver 108, a pivot 110, a foot engagement surface 116, and one or more weight plates 202. The frame 102, the arm 104, the handle 106, the weight receiver 108, the pivot 110, the foot engagement surface 116, and the one or more weight plates 202 are similar to like-numbered components described above.

In certain embodiments, the weight receiver 108 includes a post configured to interface with a standard weight plate. In one embodiment, the post is connected to the arm 104 at a receiver angle 402 relative to a horizontal plane. For example, the post may be angled such that an outer end of the post is higher than an inner end of the post. In such a configuration, the one or more weight plates 202 attached to the weight receiver 108 may be inclined such that they tend to stay securely attached to the weight receiver 108 while the arm 104 is articulated. In such a configuration, an attached weight plate 202 can be removed from the post only by being moved in a direction that has an upward component relative to the post. In one embodiment, a post of the weight receiver 108 is angled upward at approximately ten degrees from a horizontal plane.

Figure 5:
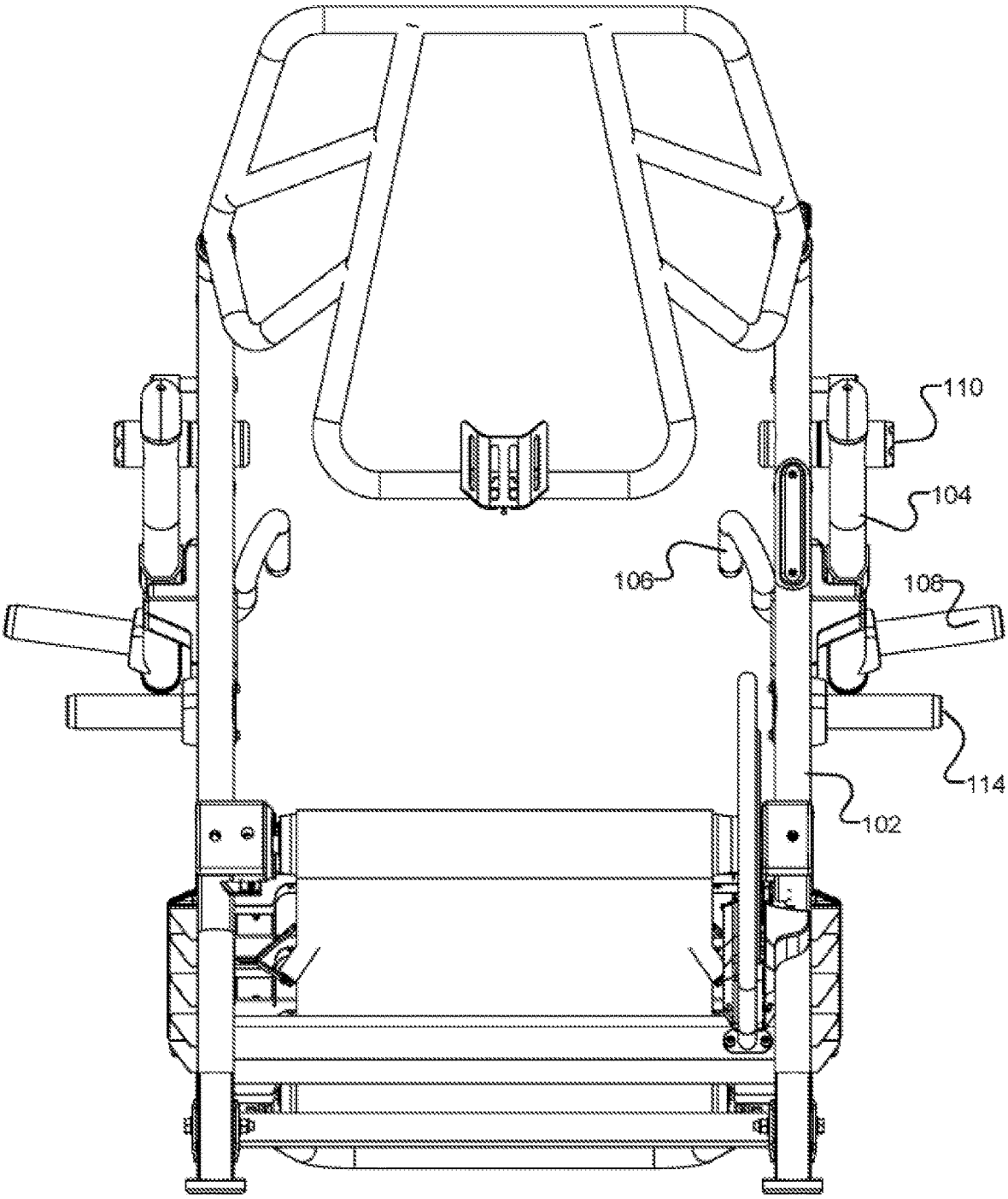
FIG. 5 depicts a front view of one embodiment of the exercise machine of FIG. 1.

FIG. 5 depicts a front view of one embodiment of the exercise machine of FIG. 1. The exercise machine 100 includes a frame 102, an arm 104, a handle 106, a weight receiver 108, a pivot 110, and a storage receiver 114. The frame 102, the arm 104, the handle 106, the weight receiver 108, the pivot 110, and the storage receiver 114 are similar to like-numbered components described above.

Figure 6:
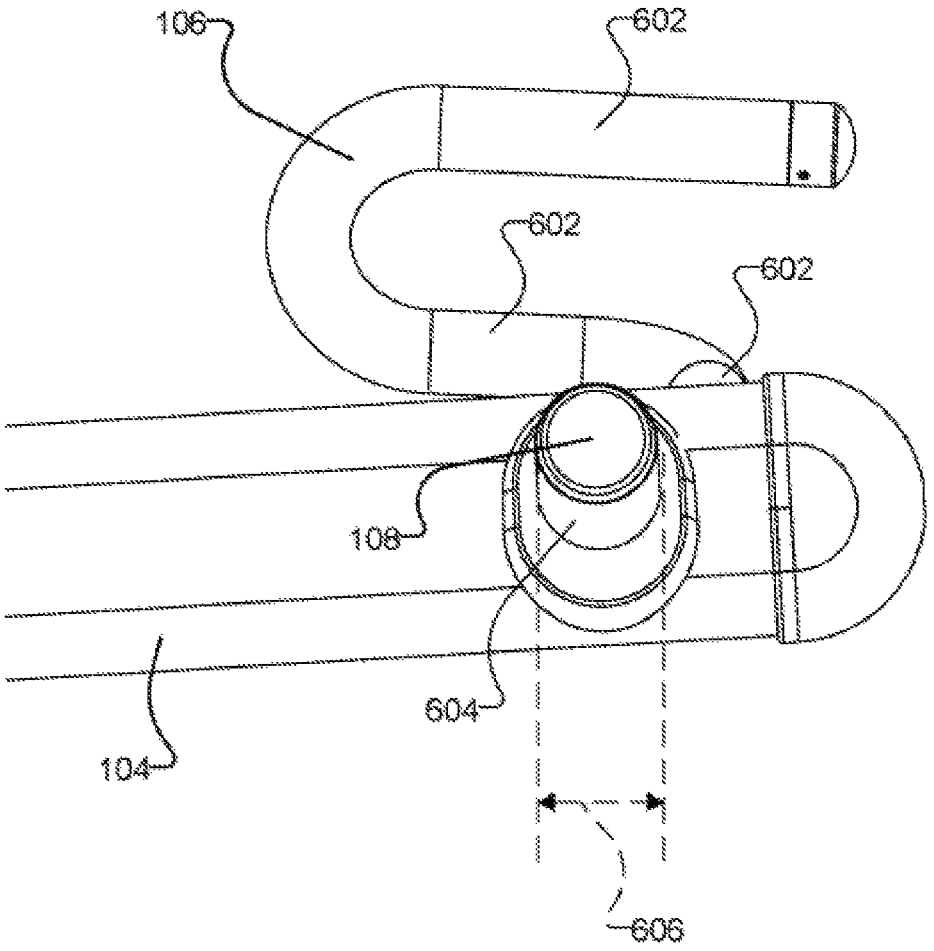
FIG. 6 depicts a side view of one embodiment of a portion of the arm of FIG. 1.

FIG. 6 depicts a side view of one embodiment of a portion of the arm 104 of FIG. 1. The arm 104 includes a handle 106 connected to the arm 104 and a weight receiver 108 connected to the arm 104. The arm 104, the handle 106, and the weight receiver 108 are similar to like-numbered components described above.

The handle 106, in one embodiment, includes one or more hand grips 602. Each of the one or more hand grips 602 are configured to be gripped by a user. A user may lift the arm 104 by applying an upward force to a hand grip. In some embodiments, the handle 106 includes a plurality of hand grips 602 to allow for gripping at different heights and in different orientations.

The weight receiver 108 in some embodiments, includes a shaft 604. The shaft 604 may be configured to interface with a weight plate. In one embodiment, the shaft 604 has a substantially circular cross section. The diameter 606 of the cross section may be sized to interface with a bore in a weight plate. For example, the shaft 604 may have a diameter sized to interface with so-called Olympic weight plates, having a bore of approximately two inches. In one embodiment, the shaft 604 may have a diameter 606 of 50 millimeters. In another example, the shaft 604 may have a diameter sized to interface with so-called standard weight plates, having a bore of approximately one inch. In one embodiment, the shaft 604 may have a diameter 606 of slightly less than one inch. In one embodiment, the shaft 604 has a substantially constant diameter 606 along a majority of its length.

Figure 7:
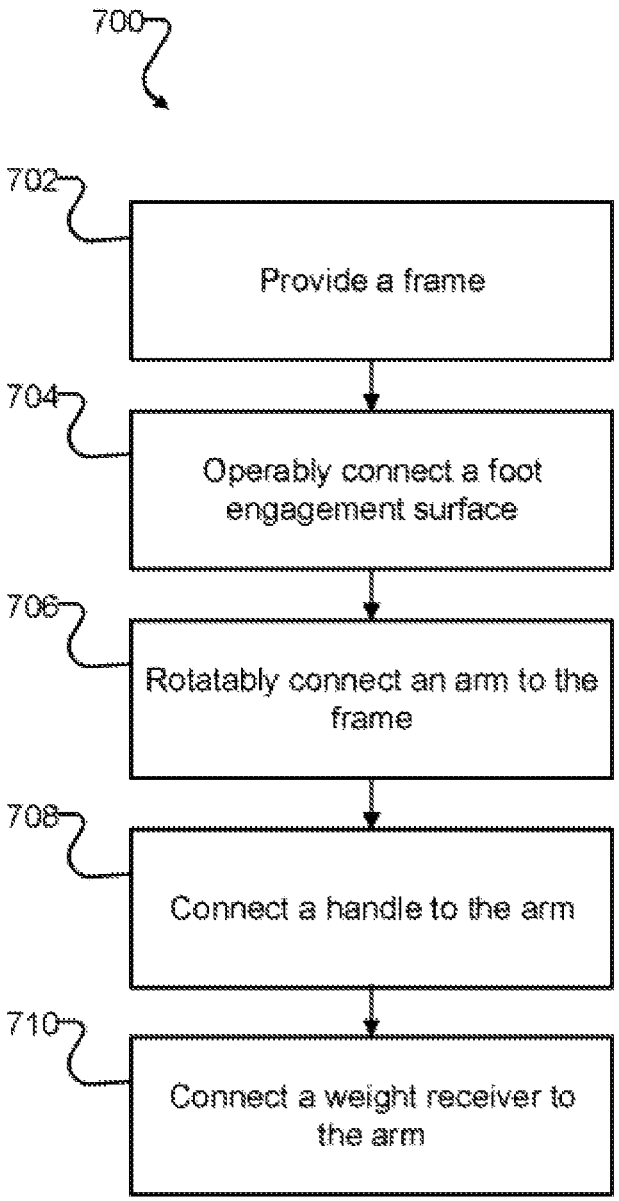
FIG. 7 is a flowchart diagram depicting one embodiment of a method for manufacturing an exercise machine.

FIG. 7 is a flowchart diagram depicting one embodiment of a method 700 for manufacturing an exercise machine 100. The method 700 is in certain embodiments a method of use of the system and apparatus of FIGS. 1-6, and will be discussed with reference to those figures. Nevertheless, the method 700 may also be conducted independently thereof and is not intended to be limited specifically to the specific embodiments discussed above with respect to those figures.

As shown in FIG. 7, a frame 102 is provided 702 in certain embodiments. The frame 102 may include connection points for other components of the exercise machine 100. In one embodiment, a foot engagement surface 116 is operably connected 704 to the frame 102. The foot engagement surface 116 may include a treadmill tread belt, a pedal, such as an elliptical machine pedal, or the like.

In some embodiments, an arm 104 is rotatably connected 706 to the frame 102. The arm 104 may be restricted to rotation around a single axis or be allowed to rotate around multiple axes. In some embodiments, downward rotation of the arm is restricted at a predetermined angle by a stop 112 connected to the frame 102.

In certain embodiments, a handle 106 is connected 708 to the arm 104. The handle may include one or more hand grips 602. The handle 106 may be connected to the arm 104 at a first location distal to a pivot 110 connecting the arm 104 to the frame 102.

In one embodiment, a weight receiver 108 is connected 710 to the arm 104. The weight receiver 108 may be configured to receive one or more weight plates. The weight receiver 108 may be located at a second position distal to the pivot 110.

The components described herein may include any materials capable of performing the functions described. Said materials may include, but are not limited to, steel, stainless steel, titanium, tool steel, aluminum, polymers, and composite materials. The materials may also include alloys of any of the above materials. The materials may undergo any known treatment process to enhance one or more characteristics, including but not limited to heat treatment, hardening, forging, annealing, and anodizing. Materials may be formed or adapted to act as any described components using any known process, including but not limited to casting, extruding, injection molding, machining, milling, forming, stamping, pressing, drawing, spinning, deposition, winding, molding, and compression molding.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by any claims appended hereto and their equivalents.

What is claimed is:

1. An exercise machine comprising:

a frame defining a longitudinal axis;

a moveable, with reference to the frame, foot engagement surface operably connected to the frame;

an arm comprising a first end and a second end, and where the arm is rotatably connected at the first end to the frame at a pivot;

a handle connected to the arm at a first location distal to the pivot and adjacent the second end, the handle configured to be gripped by a user; and a weight receiver connected to the arm at a second location distal to the pivot and adjacent the second end, the weight receiver extending outward laterally with reference to the longitudinal axis and angled upward relative to a horizontal plane, the weight receiver configured to hold one or more weights to modify a downward force provided at the handle.

2. The exercise machine of claim 1, wherein the foot engagement surface comprises a treadmill tread belt.

3. The exercise machine of claim 2, wherein a walking surface of the treadmill tread belt is inclined at an angle greater than five degrees.

4. The exercise machine of claim 1, wherein the weight receiver comprises a post configured to interface with a weight plate.

5. The exercise machine of claim 4, wherein the post has a diameter of two inches.

6. The exercise machine of claim 1, wherein the foot engagement surface comprises an elliptical exercise machine pedal.

7. The exercise machine of claim 1, wherein the first location and the second location are disposed on the arm such that a distance from the pivot to a hand grip location on the handle is substantially the same as a distance from the pivot to the second location.

8. The exercise machine of claim 1, wherein the handle comprises a plurality of hand grip locations.

9. The exercise machine of claim 1, further comprising a stop connected to the frame, the stop configured to restrict downward rotation of the arm beyond a predetermined angle.

10. The exercise machine of claim 1, further comprising a storage receiver connected to the frame configured to receive one or more weight plates.

11. The exercise machine of claim 1, further comprising a second arm connected to the frame at a second pivot, and wherein the second arm is operable independently of the arm.

12. A treadmill comprising:

a frame defining a longitudinal axis;

a treadmill tread belt operably connected to the frame, the treadmill tread belt configured to provide a continuous, moving walking surface;

a handle, disposed on an arm adjacent a first end of the arm, operably connected to the frame, the handle configured to be gripped by a user and liftable relative to the frame; and a weight receiver, disposed on the arm adjacent the first end of the arm, operably connected to the handle and extending outward laterally with reference to the frame and angled upward relative to a horizontal plane, the weight receiver configured to hold one or more weights to modify a downward force provided at the handle.

13. The treadmill of claim 12, wherein a second end of the arm is connected to the frame at a pivot, wherein the handle is connected to the arm at a first location distal to the pivot, the handle configured to be gripped by a user.

14. The treadmill of claim 13, wherein the weight receiver is connected to the arm at a second location distal to the pivot, the weight receiver configured to hold one or more weight plates to modify a downward force provided at the handle.

15. A method of manufacturing an exercise machine, the method comprising:

providing a frame that defines a longitudinal axis;

operably connecting a moveable foot engagement surface to the frame;

rotatably connecting an arm, having a first end and a second end, at the first end to the frame at a pivot;

connecting a handle to the arm at a first location distal to the pivot and adjacent to the second end, the handle configured to be gripped by a user; and connecting a weight receiver to the arm at a second location distal to the pivot and adjacent to the second end, where the weight receiver extends outward laterally with reference to the longitudinal axis and angled upward relative to a horizontal plane, the weight receiver configured to hold one or more weights to modify a downward force provided at the handle.

16. The method of claim 15, wherein the foot engagement surface is a treadmill tread belt.

17. The treadmill of claim 12, wherein the weight receiver comprises a post configured to interface with the one or more weights.

* * * * *